US006546916B2

(12) United States Patent
Hopley

(10) Patent No.: US 6,546,916 B2
(45) **Date of Patent: *Apr. 15, 2003**

(54) FUEL INJECTION PUMP TIMING MECHANISM

(75) Inventor: Daniel Jeremy Hopley, Gillingham (GB)

(73) Assignee: Delphi Technologies, Inc., Troy, MI (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/086,108

(22) Filed: Feb. 28, 2002

(65) Prior Publication Data

US 2002/0121269 A1 Sep. 5, 2002

Related U.S. Application Data

(63) Continuation-in-part of application No. 09/521,707, filed on Mar. 9, 2000, now Pat. No. 6,363,917.

(30) Foreign Application Priority Data

Mar. 10, 1999 (GB) ..... 9905339

(51) Int. Cl.[7] ..... F02M 37/04
(52) U.S. Cl. ..... 123/502; 123/449
(58) Field of Search ..... 123/502, 501, 123/500, 449

(56) References Cited

U.S. PATENT DOCUMENTS

| | | | | | |
|---|---|---|---|---|---|
| 4,010,234 | A | * | 3/1977 | Podschus | 264/117 |
| 4,037,573 | A | * | 7/1977 | Swift | 123/500 |
| 4,329,962 | A | * | 5/1982 | Johnston | 123/502 |
| 4,408,591 | A | | 10/1983 | Nakamura | |
| 4,526,154 | A | * | 7/1985 | DiDomenico | 123/502 |
| 4,557,240 | A | * | 12/1985 | Sakuranaka | 123/502 |
| 5,647,327 | A | * | 7/1997 | Enomoto et al. | 123/502 |
| 6,041,759 | A | * | 3/2000 | Burborough | 123/502 |
| 6,363,917 | B1 | * | 4/2002 | Hopley | 123/502 |

* cited by examiner

*Primary Examiner*—Carl S. Miller
(74) *Attorney, Agent, or Firm*—Thomas N. Twomey

(57) ABSTRACT

A mechanism for advancing and retarding the injection timing of a mechanically-actuated fuel injection pump. The mechanism includes a housing having a bore slidably receivable of an advance piston which cooperates with a lever of the fuel injector timing mechanism. A light load piston also in the bore cooperates with the advance piston to permit adjustment of timing under light load conditions. A rotatable cam mechanism cooperates with a flange on the light-load piston to set the axial rest position of the light-load piston and the advance piston, and hence the datum timing of the fuel injection pump. The cam may be easily set by external adjustment.

17 Claims, 4 Drawing Sheets

FUEL INJECTION PUMP TIMING MECHANISM

CROSS-REFERENCE TO RELATED APPLICATIONS

The present application is a Continuation-In-Part of a pending and allowed U.S. application Ser. No. 09/521,707, filed Mar. 9, 2000 now U.S. Pat. No. 6,363,917.

TECHNICAL FIELD

The present invention relates to the field of fuel injection pumps in which one or more cam-actuated transfer pumps is arranged to supply fuel to fuel injectors of an associated internal combustion engine. More particularly, the invention relates to mechanisms for varying the timing of fuel delivery by such pumps and, most particularly, to a mechanism for externally setting an initial position of a piston in such a pump timing mechanism to thereby set a datum timing position of the pump with respect to the rotary phase of the engine.

BACKGROUND OF THE INVENTION

In U.S. Pat. No. 6,041,759, the relevant disclosure of which is incorporated herein by reference, there is provided a mechanism for advancing and retarding fuel injection comprising an advance piston slidable within a bore, the advance piston cooperating, in use, with an actuating lever of a cam arrangement of a fuel pump to adjust the timing of fuel delivery by the pump; a servo-piston slidable in a bore provided in the advance piston; a light load piston moveable relative to the advance piston against the action of a light load control spring; a servo-control spring engaged between the light load piston and the servo-piston; a light load control valve operable to control the application of fuel to the light load piston to adjust timing under light load conditions; and an independent temperature control valve operable to control the application of fuel to the light load piston depending upon the engine temperature to permit adjustment of the timing of fuel delivery to compensate for cold conditions. The apparatus is substantially as disclosed in the present FIG. 1 which corresponds to FIG. 2 in the incorporated reference.

A prior art mechanism associated with the fuel injection pump can adjust the timing of fuel injection in accordance with, among other things, operating load and speed of the associated internal combustion engine. However, the initial datum or reference timing position of the arrangement, in relation to which adjustments by the advance mechanism takes place, is achieved by physically securing the pump to the associated engine in an empirically-determined angular orientation in relation to the pump drive mechanism. Subsequent adjustment of the datum position is particularly inconvenient, and may be extremely difficult and time-consuming, in that the engine must be run and then stopped to permit datum adjustment by loosening and further changing the angular orientation of the pump. In many installations, access to the pump mounting flange is significantly restricted.

It is a principal object of the invention to provide an improved advance mechanism for a fuel injection pump wherein the datum position of the mechanism may be adjusted externally of the mechanism without requiring rotational repositioning of the pump.

It is a further object of this invention to provide an improved advance mechanism for a fuel injection pump wherein a servo-piston can function as an element of a light load piston assembly in response to variations in engine load and can also function independently of a light load piston in response to variations in engine speed to control the position of the advance piston and hence the timing of the associated fuel injector, the datum position of the advance piston being adjustable externally of the mechanism without requiring rotational repositioning of the pump.

SUMMARY OF THE INVENTION

Briefly described, the present invention is directed to an improved mechanism for advancing and retarding the injection timing of a mechanically-actuated fuel injection pump. The mechanism includes a housing having a bore slidably receivable of an advance piston which cooperates with a lever of the fuel injecting mechanism to adjust the injection timing of a fuel injection pump. A light load piston also in the bore cooperates with the advance piston to permit adjustment of timing under light load conditions. A rotatable cam mechanism cooperates with a flange on the light-load piston to set the axial rest position of the light-load piston, and hence of the advance piston, and hence to set the datum timing of the fuel injection pump. The cam may be easily rotated by external adjustment of the mechanism.

In a preferred embodiment, a servo-piston is slidable in a bore provided in the advance piston; the light load piston is moveable relative to the advance piston against the action of a light load control spring; a servo control spring is engaged between the light load piston and the servo-piston; a light load control valve is operable to control the application of fuel to the light load piston to adjust timing under light load conditions; and an independent temperature control valve is operable to control the application of fuel to the light load piston depending upon the engine temperature to permit adjustment of the timing of fuel delivery to compensate for cold conditions.

BRIEF DESCRIPTION OF THE DRAWINGS

The foregoing and other objects, features, and advantages of the invention, as well as presently preferred embodiments thereof, will become more apparent from a reading of the following description in connection with the accompanying drawings in which.

DESCRIPTION OF THE PREFERRED EMBODIMENTS

As is well known in the prior art, and therefore not illustrated herein, a high pressure, rotary fuel pump of generally known form includes a cam ring angularly adjustable with respect to the housing of the pump, and incorporating a plurality of cam lobes. The cam ring encircles part of a distributor member which includes pumping plungers reciprocable within respective bores of the distributor member, the plungers having associated therewith respective shoe and roller arrangements, the rollers of which are engageable with the cam surface of the cam ring. In use, fuel is supplied to the bores of the distributor member by a transfer pump, pushing the plungers thereof radially outwards. The output pressure of the transfer pump is related to the rotational speed of the engine with which the pump is being used. Rotation of the distributor member relative to the cam ring causes the rollers to move relative to the cam ring, engagement of the rollers with the cam lobes causing the plungers to be forced inwards thereby pressurizing the fuel within the bores, and causing fuel to be delivered by the fuel pump at high pressure. Clearly, by altering the angular position of the cam ring, the timing at which fuel is delivered by the pump can be adjusted. Such a mechanism is shown as FIGS. 1 and 2 in the incorporated reference, U.S. Pat. No. 6,041,759. Alternatively, a single pump may be provided within a distributor housing, and the pump plunger may be rotated as well as reciprocated to distribute the pump output sequentially to a plurality of cylinder destinations, substantially as disclosed in U.S. Pat. No. 4,408,591. In either configuration, it is desirable to be able to advance and retard the timing of fuel delivery in response to various engine operating parameters.

Figure 1:
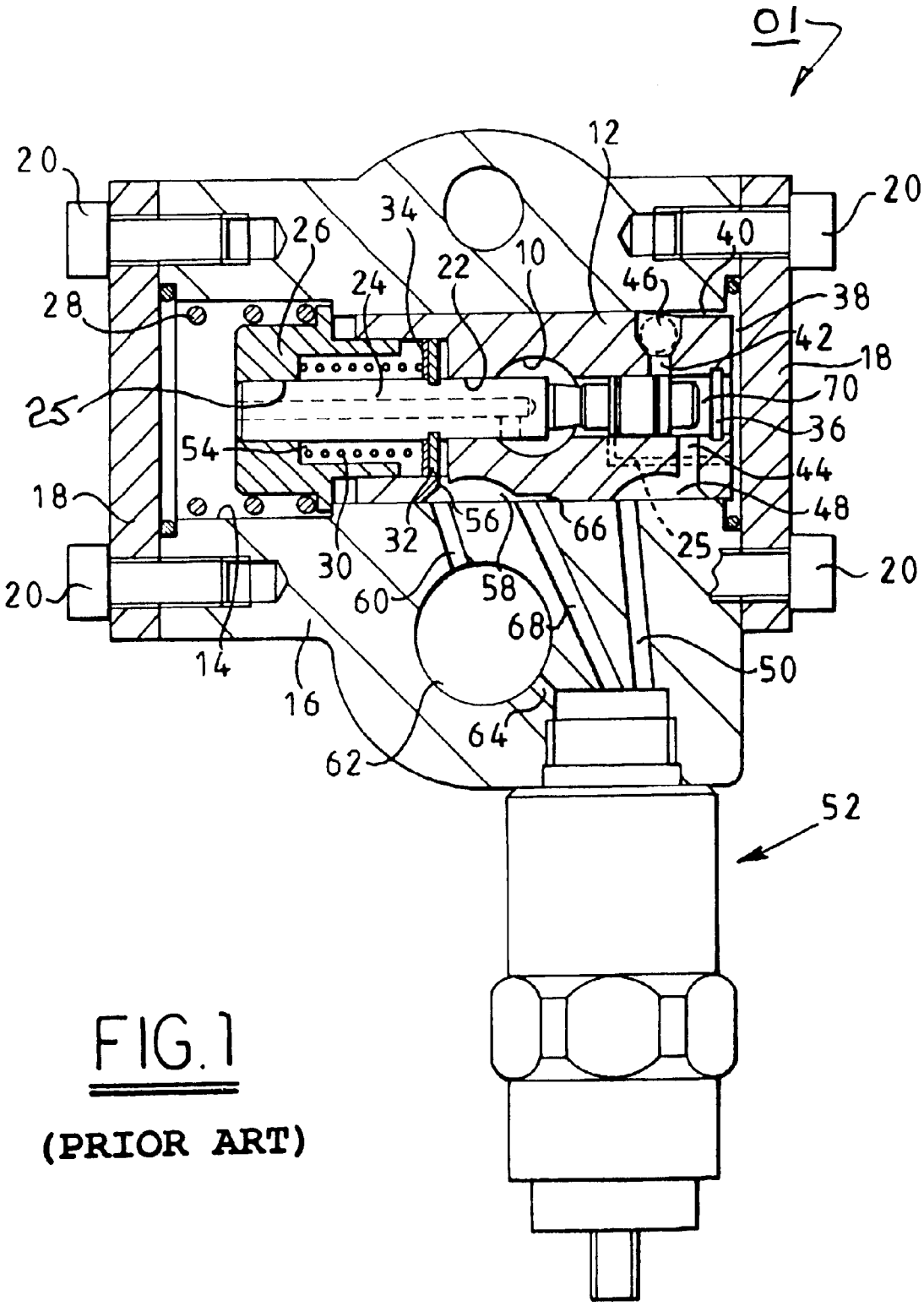
FIG. 1 (PRIOR ART)
FIG. 1 is a cross-sectional view of a timing-advance mechanism in accordance with the prior art, substantially as disclosed in U.S. Pat. No. 6,041,759.

Referring to FIG. 1, a prior art timing advance and retard mechanism is shown generally as 01. In order to permit adjustment of the angular position of the cam ring, the cam ring is provided with a lever or peg which extends into an opening 10 in an advance/retard piston 12 which is slidable within a first bore 14 provided in a cam box housing 16. For simplicity of presentation, piston 12 is referred to hereinbelow as advance piston 12, although its action to both alternatively advance and retard the injector timing should be understood.

The ends of bore 14 are closed by end plates 18 which are secured to cam box housing 16 by bolts 20, appropriate O-rings being used to seal end plates 18 to housing 16.

Advance piston 12 includes a second axially-extending bore 22 within which a servo-piston 24 is slidable. A light load piston 26 is also received within first bore 14, light load piston 26 including a third axial bore 25 through which servo-piston 24 extends, servo-piston 24 acting to guide movement of light load piston 26, servo-piston 24 enjoying a substantially fluid-tight, sliding fit within third bore 25 and second bore 22 of advance piston 12. A light load control spring 28 is engaged between light load piston 26 and one of plates 18 to bias light load piston 26 into engagement with a shoulder defined by part of bore 14.

A servo control spring 30 is engaged between light load piston 26 and an annular member 32 which is carried by servo-piston 24. A shim 34 between spring 30 and annular member 32 acts to control the maximum permitted movement of servo-piston 24 towards light load piston 26 (movement to the left in FIG. 1), the movement being limited by the engagement of shim 34 with an end surface of light load piston 26.

Figure 2:
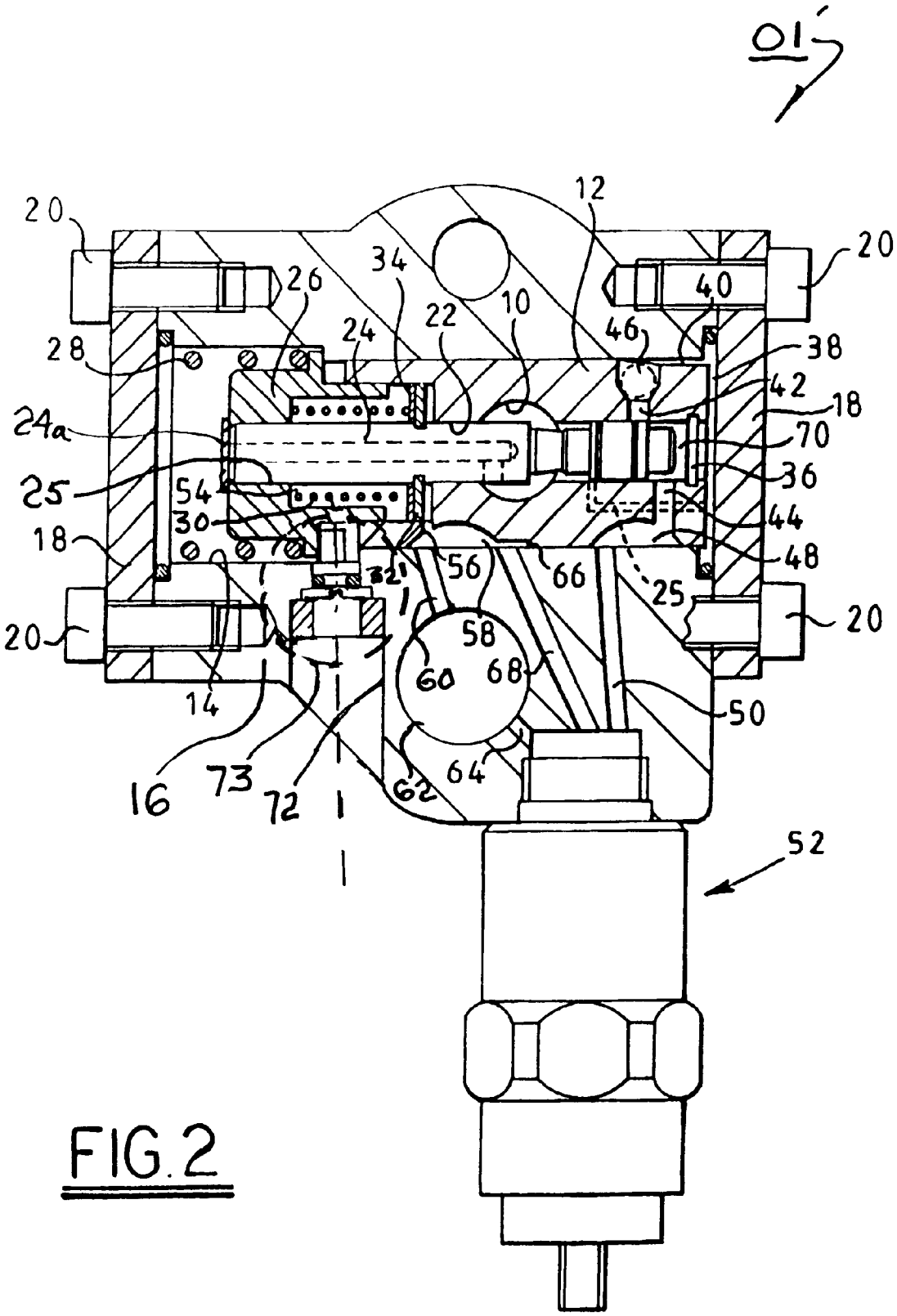
FIG. 2 is a cross-sectional view of a first embodiment of an improved timing-advance mechanism in accordance with the present invention.

Referring to FIG. 2, first imbodiment 01' is an improved advance timing mechanism in accordance with the invention and having elements substantially identical with prior art mechanism 01 as discussed thus far. However, the end of servo-piston 24 protruding through light load piston 26 is formed with a head 24*a* which engages the outer end surface of piston 26 to limit inward movement of piston 24 relative to piston 26 (movement to the right in FIG. 2).

Referring again to FIGS. 1 and 2, the end of bore 22 remote from light load piston 26 is closed by means of a disk-shaped member 36 which is located within an annular groove formed in advance piston 12, the location of member 36 being achieved, for example, using an appropriate thermal expansion technique. Alternatively, the bore may be closed by means of a core plug, bolt or the like. Clearly, movement of servo-piston 24 relative to advance piston 12 is limited by engagement of an end of servo-piston 24 with member 36.

A first control chamber 38 is defined by an end face of advance piston 12 remote from light load piston 26, the associated part of bore 14, and the associated end plate 18. First control chamber 38 communicates via a channel 40 formed in the outer periphery of advance piston 12 with a first radially-extending passage 42 within which a non-return valve 46 is located. First radially-extending passage 42 communicates with bore 22, and depending upon the position of servo-piston 24, first radially-extending passage 42 may communicate with a second radially-extending passage 44 which opens into a recess 48 provided in the outer surface of advance piston 12. Recess 48 is located so that for all permitted positions of advance piston 12 relative to housing 16, recess 48 communicates with a passage 50 which communicates with a chamber defined between housing 16 and an electromagnetically operated temperature control valve 52 mounted upon housing 16, the chamber communicating constantly with bore 64 which communicates with bore 62.

Advance piston 12 and light load piston 26 together define a second control chamber 54 within which spring 30 is located, second control chamber 54 communicating with a third radially extending passage 56 which opens into a recess 58 provided in the outer surface of advance piston 12. Recess 58 is located so that for all permitted positions of advance piston 12, recess 58 communicates with a passage 60 which communicates with bore 62.

Extending from recess 58, the outer surface of advance piston 12 is provided with a short flat 66 which, depending upon the axial position of the advance piston 12, is arranged to communicate with a passage 68 which communicates with temperature control valve 52.

Under normal operating conditions, under which the engine is relatively hot and the engine load is relatively high, temperature control valve 52 is switched so that fuel at transfer pressure is supplied through passage 64 to passage 50, but is not supplied to passage 68. Further, the metering valve supplies fuel at low pressure to passage 60. In these conditions, fuel pressure within second control chamber 54 is relatively low, and thus (in the prior art) light load piston 26 is biased by means of spring 28 into engagement with a shoulder of bore 14 as shown in FIG. 1; the rest position of piston 26 with respect to housing 16 thus is not variable in the prior art. Fuel at transfer pressure is supplied through passage 50, recess 48 and passage 44 to a chamber 70 defined by bore 22 of advance piston 12, the end of servo-piston 24 and member 36. In the position shown, servo-piston 24 occupies a position in which communication between chamber 70 and first radially-extending passage 42 is not permitted. However, should the speed of rotation of the engine increase, resulting in an increase in fuel transfer pressure, fuel pressure within chamber 70 may increase to a sufficient extent to cause movement of servo-piston 24 against the action of spring 30 to a position in which communication between chamber 70 and first radially-extending passage 42 is permitted. In these circumstances, fuel flows from chamber 70 through first radially-extending passage 42 and past non-return valve 46 into first control chamber 38. Flow of fuel into chamber 38 increases pressure therein, applying a force to advance piston 12 causing piston 12 to move towards the left in the orientation illustrated in FIGS. 1–3. Movement of advance piston 12 in this direction causes movement of the cam ring, due to the cooperation of the peg with the opening 10, to advance the timing of fuel delivery by the pump to the engine.

It will be appreciated that at the instant at which the rollers move into engagement with the cam lobes provided on the cam ring, a significant force is transmitted through the cam ring and peg to advance piston 12, tending to move advance piston 12 towards the right in the orientation illustrated. Clearly such movement would tend to increase fuel pressure within control chamber 38; thus, non-return valve 46 is provided in order to avoid the increase in fuel pressure within chamber 38 causing undesirable fuel flow in the reverse direction.

Once the movement of advance piston 12 results in passage 42 being closed by servo-piston 24, supply of fuel to chamber 38 is terminated and movement of advance piston 12 in this direction ceases.

Clearly, in circumstances in which it is desirable to retard the timing of fuel delivery by the pump, advance piston 12 must move towards the right in the orientation illustrated. In such circumstances, the transfer pressure falls, and thus servo-piston 24 also moves towards the right. Movement of the servo-piston 24 relative to advance piston 12 beyond a predetermined position results in a drain passage 27 being uncovered permitting fuel to escape from control chamber 38 to the cam box of the high pressure fuel pump. The fuel pressure within control chamber 38 thus falls, resulting in movement of advance piston 12 to the right. Movement of advance piston 12 ceases upon advance piston 12 having moved to a position in which drain passage 27 is occluded by servo-piston 24.

It is intended that the maximum permitted timing advance is relatively small. In practice, the maximum timing advance is limited by the engagement of the end of advance piston 12 remote from control chamber 38 with light load piston 26.

Referring to conditions wherein the engine is operating at a relatively light load and is hot, the metering valve allows fuel pressure applied to passage 60 to rise. Hence, fuel pressure applied to second control chamber 54 also rises. The application of fuel at increased pressure to chamber 54 results in movement of light load piston 26 against the action of spring 28, and application of fuel to chamber 70 as described hereinbefore causes movement of servo-piston 24 to the left in the orientation illustrated. As described hereinbefore, this movement of servo-piston 24 permits fuel to flow to first control chamber 38, resulting in movement of advance piston 12 to the left, thus advancing the timing of fuel delivery by the pump.

It will be understood that moving light load piston 26 has an effect upon the relationship between engine speed and the rate of adjustment of timing of fuel delivery by the pump, and also as light load piston 26 is moved, the maximum permitted level of advance is also increased.

For both of the operating conditions described hereinbefore, temperature control valve 52 may be switched in order to adjust timing to compensate for the engine's being cold. The effect of switching temperature control valve 52 is that fuel at transfer pressure is supplied to passage 68. In this condition, fuel from passage 68 flows through flat 66 to recess 58 and from there to second control chamber 54. The application of fuel to second control chamber 54 results in movement of light load piston 26, and described hereinabove, resulting in adjustment of the position of advance piston 12. If the engine is running at high load, this fuel is not being supplied through passage 60 to second control chamber 54. After a predetermined movement of advance piston 12, passage 68 no longer registers with flat 66, thus fuel is no longer permitted to flow to second control chamber 54. This break in communication results in movement being limited of light load piston 26 to the left in the orientation illustrated. However, should the engine be operating at light load conditions, fuel is able to flow through passage 60 to second control chamber 54, and thus movement of light load piston 26 to the left continues.

The provision of such an advance arrangement has the advantage that the high load conditions can operate over an increased pressure range, thus permitting an increase in the stiffness of spring 30, resulting in greater stability and more consistent operation. The light load advance condition can also operate over a larger pressure range without interfering with the operation of the advance arrangement load conditions. As separate springs 28,30 are used to control the operation under full load and light load, the characteristics of these springs can be optimized for the pump with which the advance arrangement is to be used. Also, as, at full load, movement of servo-piston 24 is limited by engagement with light load piston 26, the maximum advance position of advance piston 12 is well defined, and operation of the engine under these conditions is more stable.

Clearly, by altering the length of flat 66, the maximum advance under cold conditions at full load can be controlled independently of the other operating characteristics of the arrangement. Under light load conditions, the length of flat 66 is of less importance as the position of light load piston 26 is determined by the pressure of fuel supplied through passage 60 to second control chamber 54 under these conditions.

Conveniently, temperature control valve 52 takes the form of a conventional stop solenoid which is supplied with electrical current only when the engine is at low temperature. Clearly, should the temperature control valve 52 fail, it is likely to fail in the high temperature condition. This has the advantage that breaking the supply to control valve 52 does not result in improved performance of the engine at the expense of emissions, thus reducing the risk of tampering.

Although the description hereinabove is of a fuel pump of the type in which pumping plungers move in a radial direction in order to supply fuel at high pressure to an engine, it will be appreciated that the advance arrangement may be applicable to other types of high pressure fuel pump.

Although the advance arrangement described above provides for advancing and retarding of the timing of the point in the engine cycle at which fuel is injected into the associated internal combustion engine, there remains the problem of establishing a datum timing position in relation to which adjustment of the timing is effected by the advance arrangement.

In the prior art, setting of the timing datum for fuel injection is effected by adjusting the physical position of the pump housing relative to the internal combustion engine about the axis of rotation of the drive arrangement for the pump. In essence, the pump housing is adjusted angularly about the axis of rotation of the pump drive arrangement and is then clamped in an adjusted position by bolts which secure the pump housing to the internal combustion engine. As mentioned above, such an arrangement is disadvantageous, and FIGS. 2 and 3 illustrate a modification of the prior art advance mechanism shown in FIG. 1, by which the timing datum may be adjusted simply and conveniently.

Figure 3:
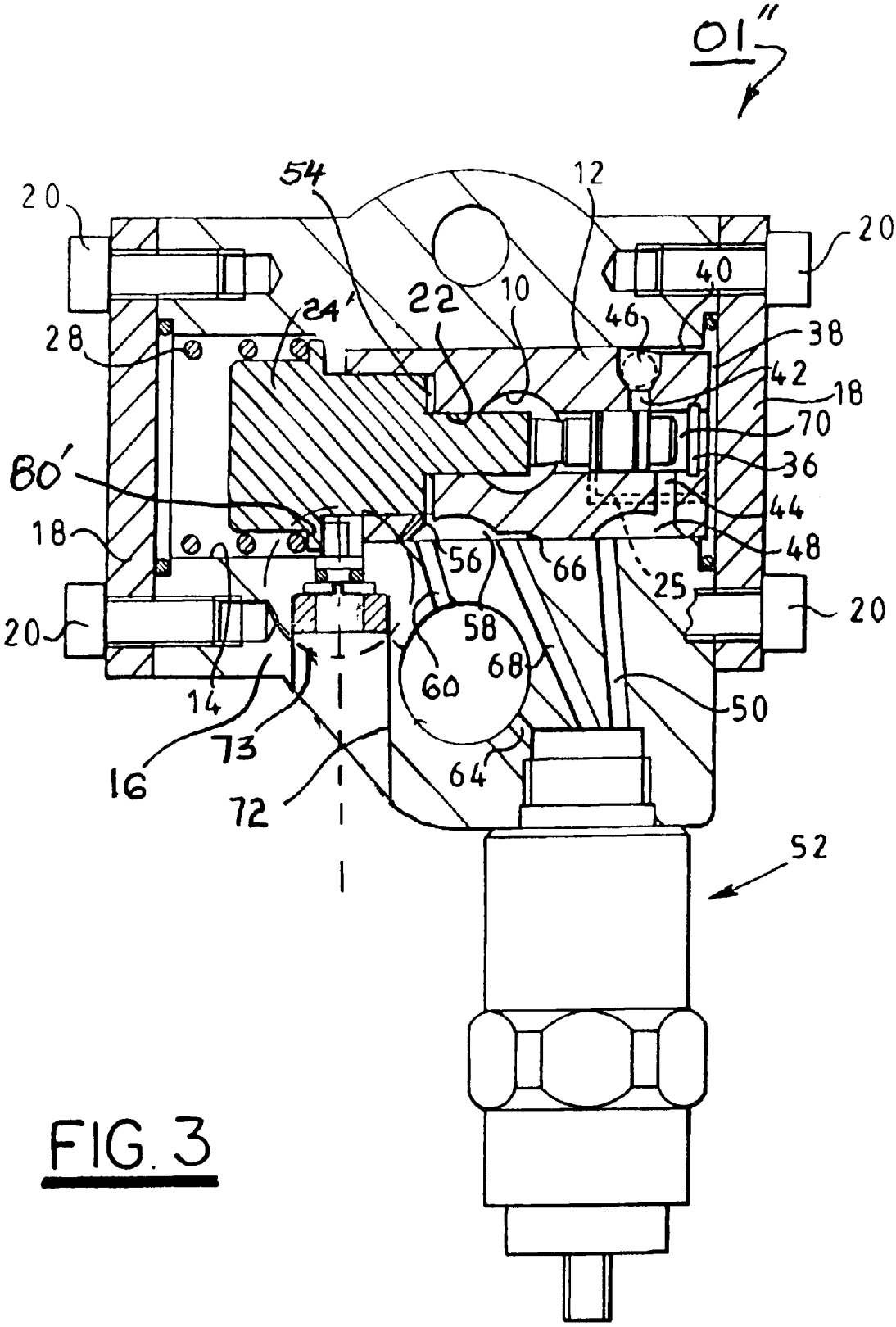
FIG. 3 is a cross-sectional view of a second embodiment of an improved timing-advance mechanism in accordance with the present invention.
Figure 4:
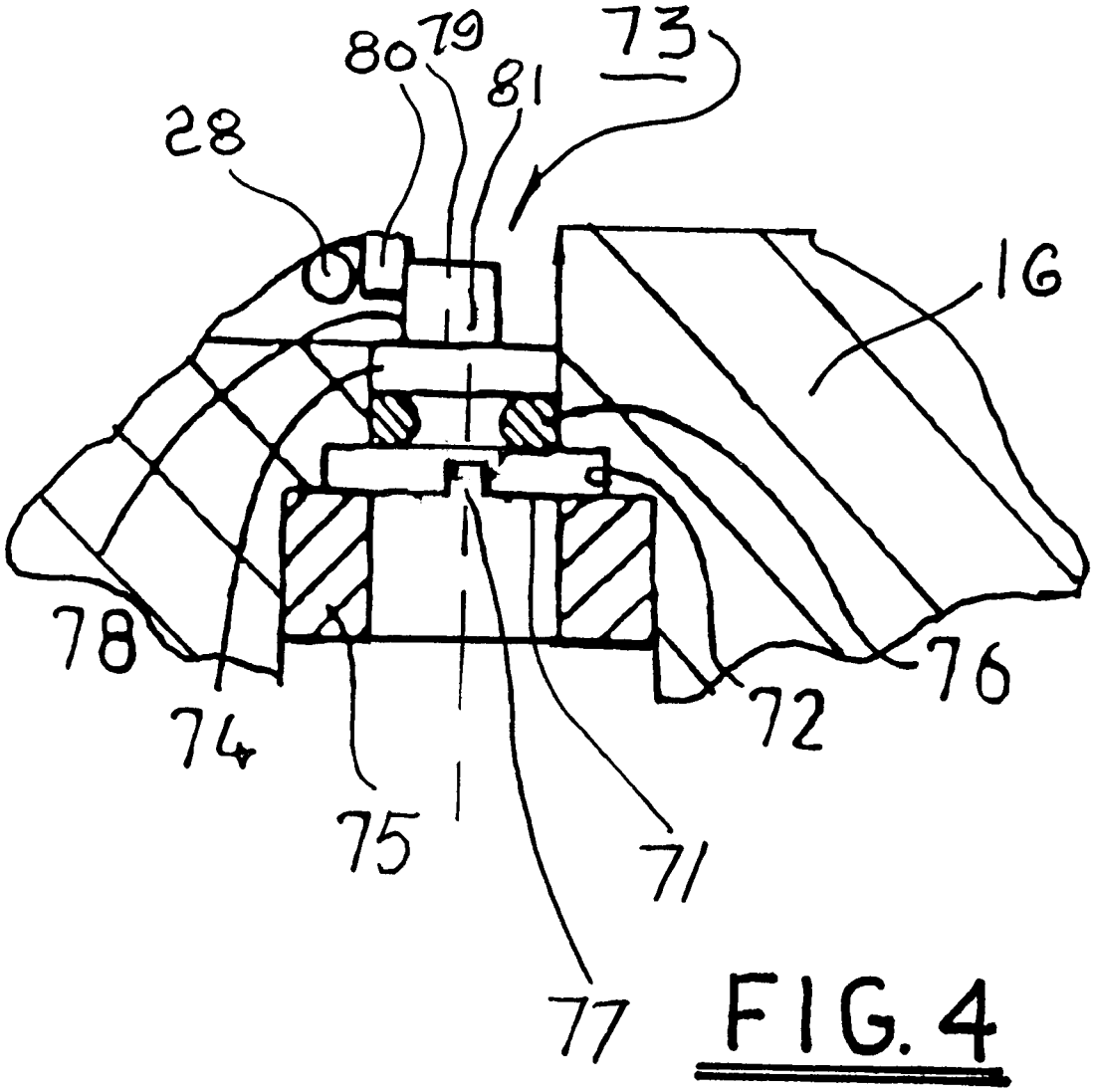
FIG. 4 is a cross-sectional view of a novel datum-setting mechanism for use with a timing-advance mechanism in accordance with the invention.

Referring to FIGS. 2, 3, and 4, the wall of housing 16 is formed with a stepped transverse bore 72 for receiving a datum-setting mechanism 73, shown in detail in FIG. 4, including a rotatable abutment member 74. Abutment member 74 is retained in an inner narrower region of bore 72 by a locking ring 75 in screw-threaded engagement with the wall of an outer wider region of bore 72. Abutment member 74 further defines outer surface 71 having tool engagement means 77, such as, for example, a screw driver slot, for easy manual rotation of member 74. The rotating interface of member 74 and bore 72 is sealed by an O-ring seal 76 carried in a groove of member 74 and engaging the plain wall of the inner region of bore 72.

The axis of rotation of the member 74 extends at right angles to, and intersects with, the common longitudinal axis of light load piston 26 and advance piston 12. Member 74 includes an eccentric post 78 which projects parallel to the axis of member 74 and is engageable with one face of a radially outwardly extending circumferential flange 80 of light load piston 26, the opposite face of which forms a seating receiving one end of light load control spring 28.

Post 78 preferably is circular in cross-section and its axis 79 is parallel to, but spaced laterally from, axis 81 of rotation of the remainder of member 74. Post 78 forms an eccentric abutment against which flange 80 engages under the action of spring 28, and thus defines the rest position of light load piston 26 (and, by virtue of spring 30 and head 24*a*, the rest position of servo-piston 24) relative to housing 16 and advance piston 12. Rotation of member 74 in housing 16 thus adjusts the axial location of the rest position of the light load piston 26 and the servo-piston 24.

The timing datum for the pump with which the advance mechanism is associated is defined by the rest position of the light load piston within housing 16, and thus rotation of member 74 through an arc of 180° displaces the rest position of light load piston 26 between maximum and minimum positions. The actual distance between the maximum and minimum positions is, of course, determined by the eccentricity of post 78 relative to the axis of rotation of member 74. Conveniently, the eccentricity can be of the order of 0.4 mm giving a total "throw" of about 0.8 mm and thus an adjustment of the datum position of plus or minus about 0.4 mm from a central position of the adjustable abutment member 74.

In use, the advance mechanism preferably is assembled with member 74 in its intermediate rotational position so that, after the adjuster and the injection pump have been assembled to the associated internal combustion engine, member 74 can be turned in one direction or the other to give the appropriate adjustment of the timing datum without the need to physically alter the position of the pump housing relative to the internal combustion engine.

It will be recognized that, if desired, the eccentric post 78 could be replaced by some form of cam shaping at the inner end of member 74 to cooperate with piston 26 to achieve a desired range and characteristic of adjustment. After adjustment, member 74 preferably is locked in its adjusted position relative to the housing by screwing locking ring 75 inwardly to clamp a peripheral shoulder of member 74 against a shoulder defined by a stepped region of bore 72, the central aperture of ring 75 conveniently being hexagonal to receive and cooperate with a tightening tool.

Referring to FIG. 3, a second embodiment 01" of an advance timing mechanism in accordance with the invention is shown. Mechanism 01" is a simpler apparatus than mechanism 01' shown in FIG. 2, having only an advance piston 12 and a servo-piston 24', and lacking a separate light load piston and spring. Servo-piston 24' includes a flange 80' similar to flange 80 in FIG. 2 for engaging a datum-setting mechanism 73, by which the datum timing position of advance piston 12 may be set.

Servo piston 24' is responsive to speed dependent fuel pressure variations within servo chamber 70 similar to that described above and shown in FIG. 2. If servo piston 24' is required to provide light load advance as well, such that the position of servo piston 24' is varied in response to both engine speed and engine load, passage 60 to recess 58 is provided, as shown in FIG. 3, so as to permit a load dependent fuel pressure to be applied to a second control chamber 54 in addition to the speed dependent fuel pressure applied to servo chamber 70.

In an alternate embodiment, servo piston 24' of mechanism 01" may be responsive only to a load dependent pressure signal applied to chamber 70. In this case, the function of servo piston 24' is effectively that of light load piston 26 in mechanism 01' of FIG. 2. This is desirable for applications in which there is no requirement to vary the timing of fuel delivery with engine speed. In this embodiment, there is no need to provide passage 60 to recess 58.

While the invention has been described with reference to preferred embodiments, it will be understood by those skilled in the art that various changes may be made and equivalents may be substituted for elements thereof without departing from the scope of the invention. In addition, many modifications may be made to adapt a particular situation or material to the teachings of the invention without departing from the scope of the invention. Therefore, it is intended that the invention not be limited to the particular embodiments disclosed as the best mode contemplated for carrying out this invention, but that the invention include all embodiments falling within the scope and spirit of the appended claims.

What is claimed is:

1. A mechanism for a fuel injection pump for adjustably advancing and retarding the timing of fuel injection to an internal combustion engine in response to engine operating parameters, the fuel injection pump having a movable peg for varying the angular position of a cam ring, the mechanism comprising:

a housing having a first bore and having a first axis;

a first piston slidably disposed in said first bore in engagement with said peg, said first piston having a second bore coaxial with said first bore;

a second piston slidably disposed in said first bore, said second piston having a piston portion extending into said second bore, and said second piston defining a first surface, said second piston being slidably responsive to at least one of said engine operating parameters;

an adjusting means disposed, at least in part, within said housing for varying an axial rest position of said second piston with respect to said housing corresponding to a limit of travel thereof, wherein the adjusting means defines a stop surface which is engageable with the first surface of said second piston to fix a first axial position of said second piston and thereby to set the timing datum for the fuel injection pump; and first control spring means disposed in compression against said second piston for urging said second piston toward said first piston.

2. A mechanism in accordance with claim 1, wherein said first surface of said second piston is defined by a circumferential flange.

3. A mechanism in accordance with claim 1, wherein said adjusting means comprises an adjustable datum-setting mechanism having rotatable eccentric means which define said stop surface.

4. A mechanism in accordance with claim 3 wherein said datum-setting mechanism includes a tool engagement means to permit external setting of said axial position of said second piston with respect to said housing.

5. A mechanism in accordance with claim 3 wherein said eccentric means is rotatable about a second axis orthogonal to said first axis.

6. A mechanism in accordance with claim 5 wherein said eccentric means cooperates with said first surface of said second piston such that rotation of said eccentric means about said second axis adjusts a rest position of said second piston with respect to said housing.

7. A mechanism in accordance with claim 6 further comprising means for locking the position of said eccentric means to set said rest position.

8. A mechanism in accordance with claim 1, wherein said first piston is a timing advance piston and said second piston is a light load piston.

9. A mechanism for a fuel injection pump for adjustably advancing and retarding the timing of fuel injection to an internal combustion engine in response to engine operating parameters, the fuel injection pump having a movable peg for varying the angular position of a cam ring, the mechanism comprising:

a housing having a first bore and having a first axis;

a first piston slidably disposed in said first bore in engagement with said peg, said first piston having a second bore coaxial with said first bore;

a second piston slidably disposed in said first bore, said second piston having a piston portion extending into said second bore, and said second piston defining a first surface, said second piston being slidably responsive to at least one of said engine operating parameters, said second piston including a light load piston having a third bore, a third piston slidably disposed in said third bore and said second bore; and an adjusting means disposed, at least in part, within said housing for varying an axial rest position of said second piston with respect to said housing corresponding to a limit of travel thereof, wherein the adjusting means defines a stop surface which is engageable with the first surface of said second piston to fix a first axial position of said second piston and thereby to set the timing datum for the fuel injection pump.

10. A mechanism in accordance with claim 9 wherein said third piston is a servo-piston having first and second end portions terminating in first and second ends, respectively, and having an annular member formed between said first and second ends, said first end portion having a circumferential head disposed outside said third bore for engaging said light load piston and said second end portion being disposed in said second bore for servo-controlling the movement of said first piston.

11. A mechanism in accordance with claim 10 further comprising a second control spring disposed in said second piston assembly between said light load piston and said servo-piston for urging said servo-piston into said second bore.

12. A mechanism in accordance with claim 11 further comprising a light load control valve for controlling the application of pressurized fuel to said light load piston to adjust injector timing under light load engine operating conditions, and further comprising an independent temperature control valve for controlling application of pressurized fuel to said light load piston as a function of engine temperature.

13. A fuel injection pump comprising a mechanism for adjustably advancing and retarding the timing of fuel injection in response to engine operating parameters, the fuel injection pump having a movable peg for varying the angular position of a cam ring, the mechanism including:

a housing having a first bore and having a first axis;

a first piston slidably disposed in said first bore in engagement with said peg, said first piston having a second bore coaxial with said first bore;

a second piston slidably disposed in said first bore, said second piston having a piston portion extending into said second bore, and said second piston defining a first surface, said second piston being slidably responsive to at least one of said engine operating parameters;

an adjusting means disposed, at least in part, within said housing for varying an axial rest position of said second piston with respect to said housing corresponding to a limit of travel thereof, wherein the adjusting means defines as a stop surface which is engageable with the first surface of said second piston to fix a first axial position of said second piston and thereby to set the timing datum for the fuel injection pump; and first control spring means disposed in compression against said second piston for urging said second piston toward said first piston.

14. A mechanism for a fuel injection pump for adjustably advancing and retarding the timing of fuel injection to an internal combustion engine in response to engine operating parameters, the fuel injection pump having a movable peg for varying the angular position of a cam ring, the mechanism comprising:

a housing having a first bore and having a first axis;

a first piston slidably disposed in said first bore in engagement with said peg, said first piston having a second bore coaxial with said first bore;

a second piston slidably disposed in said first bore, said second piston having a piston portion extending into said second bore, and said second piston defining a first surface, said second piston being slidably responsive to at least one of said engine operating parameters; and an adjusting means disposed, at least in part, within said housing for varying an axial rest position of said second piston with respect to said housing corresponding to a limit of travel thereof, wherein the adjusting means defines a stop surface which is engageable with the first surface of said second piston to fix a first axial position of said second piston and thereby to set the timing datum for the fuel injection pump;

wherein said adjusting means comprises an adjustable datum-setting mechanism having rotatable eccentric means which define said stop surface, said eccentric means being rotatable about a second axis orthogonal to said first axis.

15. A mechanism in accordance with claim 14, wherein said eccentric means cooperates with said fist surface of said second piston such that rotation of said eccentric means about said second axis adjusts a rest position of said second piston with respect to said housing.

16. A mechanism in accordance with claim 15, further comprising means for locking the position of said eccentric means to set said rest position.

17. A mechanism for a fuel injection pump for adjustably advancing and retarding the timing of fuel injection to an internal combustion engine in response to engine operating parameters, the fuel injection pump having a movable peg for varying the angular position of a cam ring, the mechanism comprising:

a housing having a first bore and having a first axis;

a first piston slidably disposed in said first bore in engagement with said peg, said first piston having a second bore coaxial with said first bore;

a second piston slidably disposed in said first bore, said second piston having a piston portion extending into said second bore, a circumferential flange surface defined by said second piston, said second piston being slidably responsive to at least one of said engine operating parameters; and an adjusting means disposed, at least in part, within said housing for varying an axial rest position of said second piston with respect to said housing corresponding to a limit of travel thereof, wherein the adjusting means defines a stop surface which is engageable with the circumferential flange surface to fix a first axial position of said second piston and thereby set the timing datum for the fuel injection pump.

* * * * *